United States Patent [19]

Lorenz et al.

[11] 4,342,412

[45] Aug. 3, 1982

[54] TILT-BOX FOR GUIDING A CONTINUOUSLY MOVING WEB

[76] Inventors: Otto Lorenz, Schwibbogenplatz 2b, 8900 Augsburg; Merten Keller, Alter Fischbacher Weg 1, 6239 Eppstein, both of Fed. Rep. of Germany

[21] Appl. No.: 240,891

[22] Filed: Mar. 5, 1981

[30] Foreign Application Priority Data

Mar. 7, 1980 [DE] Fed. Rep. of Germany ..... 3008775

[51] Int. Cl.[3] ..... B65H 25/26

[52] U.S. Cl. ..... 226/21

[58] Field of Search ..... 226/21, 22, 23, 15, 226/16, 17, 18, 19, 20, 3; 242/57.1; 26/51.3, 51.4, 51.5

[56] References Cited

U.S. PATENT DOCUMENTS

| | | | |
|---|---|---|---|
| 2,607,588 | 8/1952 | Morey | 226/23 |
| 3,326,435 | 6/1967 | Shelton | 226/22 |
| 3,373,288 | 3/1968 | Otepka et al. | 226/21 X |
| 3,411,683 | 11/1968 | Bartles et al. | 226/21 |
| 3,615,048 | 10/1971 | Martin | 226/20 |
| 3,682,362 | 8/1972 | Ott, Jr. | 226/21 |
| 3,724,732 | 4/1973 | Bonner | 226/21 |
| 3,966,105 | 6/1976 | Curran | 226/21 |
| 4,069,959 | 1/1978 | Bartell et al. | 226/21 |
| 4,291,825 | 9/1981 | Glanz | 226/18 |

*Primary Examiner*—Stanley N. Gilreath
*Attorney, Agent, or Firm*—Karl F. Ross

[57] ABSTRACT

A guide apparatus for a continuously moving web has an upstream fixed roller and a downstream fixed roller substantially parallel to each other and defining a plane. A fixed and substantially closed box carries these rollers and a frame which is offset from the plane and pivotal on the box about a frame axis substantially perpendicular to the plane. A pair of adjustment rollers are rotatable on the frame about parallel adjustment-roller axes fixed relative to each other and to the frame. Thus a continuously moving web can pass along the path over the upstream roller, then over one after the other of the adjustment rollers, and finally over the downstream roller. A sensor is mounted on the box adjacent the downstream roller and is connected via a control means to a motor inside the box that automatically pivots the frame whenever the web position detected by the sensor deviates from a predetermined desired position. Thus all of the critical circuitry and moving parts of the apparatus are safely within the closed box.

15 Claims, 3 Drawing Figures

TILT-BOX FOR GUIDING A CONTINUOUSLY MOVING WEB

FIELD OF THE INVENTION

The present invention relates to a guide apparatus or so-called tilt box for a continuously moving web. More particularly this invention concerns such an apparatus used to align a sheet of paper laterally as it is fed through a printing press or the like.

BACKGROUND OF THE INVENTION

A so-called tilt box is used to guide a continuously moving web in a printing operation, although it is possible to use such devices also in the textile field. Such a guide apparatus or tilt box eliminates so-called sidelay error which occurs in printing when a splice is improperly made between succeeding paper webs, or when the web being fed is not perfectly flat. The purpose of such a machine is to insure that any sidelay error upstream is eliminated downstream.

The standard such device includes a frame carrying a pair of adjustment rollers. The web is passed in a non-straight path over these adjustment rollers so as to engage both of them over a substantial arc. This frame can be pivoted about an axis perpendicular to that of the web. In this manner pivoting of the frame so that the axes of its rollers do not lie perfectly perpendicular to the direction of travel of the paper over them will laterally displace the web. Sensors are normally provided somewhat downstream of the apparatus that controls the motor that pivots the frame so as automatically to eliminate any sidelay error appearing downstream.

Typically such apparatuses, as seen in U.S. Pat. No. 3,615,048, have a relatively open construction or frame. The motor as well as the various control and sensing devices are provided normally immediately adjacent the adjustment rollers. Frequently the sensors are connected via loose wires to the motor.

The disadvantages of this type of system is that it is normally functioning in an extremely dusty environment. Thus all of these parts quickly become covered with dust, creating considerable danger of malfunctioning due to all this dust in the mechanism. Another disadvantage is that such a system is relatively dangerous to work near, as the exposed mechanism and electrical or pneumatic lines can be hazardous.

OBJECTS OF THE INVENTION

It is therefore an object of the present invention to provide an improved guide apparatus of the tilt-box type for a continuously moving web.

Another object is to provide such an apparatus which, even though operating in a relatively dirty environment, can be assured of a relatively long service life.

Yet another object is to provide such an apparatus which is substantially simpler than the hitherto known devices, but which is relatively easy to service and operate.

SUMMARY OF THE INVENTION

These objects are attained according to the instant invention in a guide apparatus having an upstream fixed roller and a downstream fixed roller substantially parallel to each other and defining a plane. A fixed and substantially closed box is provided between these upstream and downstream rollers and carries a frame offset from the plane and pivotal on the box about a frame axis substantially perpendicular to the plane. Two adjustment rollers are rotatable on the frame about parallel adjustment-roller axes fixed relative to each other and to the frame and offset from the plane. Thus a continuously moving web can pass along the path over the upstream roller, over one of the adjustment rollers, over the other adjustment roller, and over the downstream roller. A sensor mounted along the web downstream of the other adjustment roller is connected via control means to a motor inside the box which is connected to the frame and which is energizable to pivot the frame on the box about the frame axis. The control means connected between the sensor and the motor pivots the frame on the box when the web position detected by the sensor deviates from a predetermined desired position.

Thus with the system according to the instant invention it is possible to contain all of the critical equipment inside a substantially closed box that also acts as the mount for much of the equipment according to this invention.

In accordance with another feature of this invention the frame is provided at the frame axis with a pivot pin received in a bearing or journal mounted fixedly on the box. This pin is provided with a radially projecting arm connected via a link to an arm carried on the motor shaft. Both of these arms and the link are normally mounted inside the box, although it is possible to mount them outside as they represent relatively insensitive structure. A spring, normally a tension spring, is braced between the motor arm and the box and urges the free end of the motor arm away from the pin so as to eliminate any play in the system.

In accordance with another feature of this invention the upstream and downstream rollers are mounted fixedly on the box, as is the sensor or sensors of the paper edge or centerline. Thus the entire assembly comprises a compact single unit which can very easily be mounted in place, or removed for servicing.

The frame according to this invention has an upstream end provided with the one adjustment roller and located at the frame axis and a downstream end provided with the other adjustment roller. Rollers on the frame and arail or respective rails on the box support this downstream end on the box for oscillatory motion about the frame axis. Providing two rollers at each of the two downstream corners of the frame, with the rollers of each pair spaced apart parallel to the frame axis and embracing the respective rail insures that the system will work even upside down or at any position. What is more the integrity of the system as a single unit which need nearly be supplied with power, either pneumatic or electric, is retained with this type of system.

In accordance with another feature of this invention the box is formed of a tube of square or rectangular section, of the extruded type readily available of the open market. A pair of end plates, at least one which is recessed in the tube, close the ends thereof. The recessed end piece can, according to another feature of this invention, carry the gauges and controls for the control means.

Thus in accordance with the instant invention the one fixed upstream roller can be mounted on one corner of the box, the downstream roller on an adjacent corner and the two adjustment rollers with their frame on the opposite two corners. This makes the assembly extremely neat and relatively easy to insert into any conveyor line for a continuously moving web.

SPECIFIC DESCRIPTION

Figure 1:
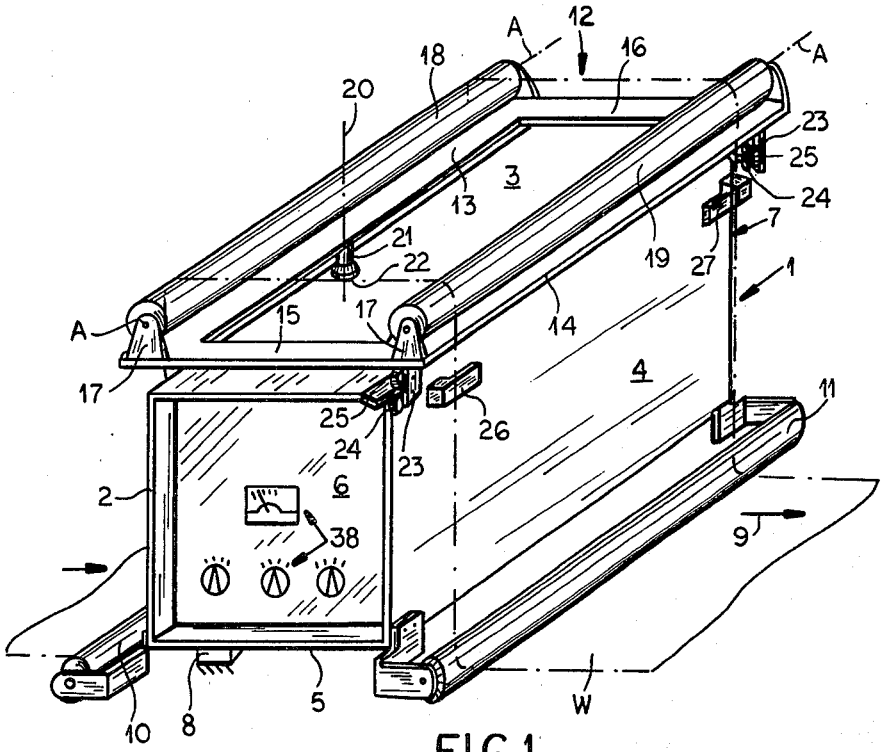
FIG. 1 is a perspective end view of the apparatus according to this invention.

As seen in FIG. 1 the guide apparatus for a continuously moving web W basically has a box housing 1 having an upstream wall 2, a top wall 3, a downstream wall 4, a bottom wall 5, and a pair of recessed end walls 6 and 7. The walls 2–5 are formed by a piece of rigid one-piece metallic tubing of the type commercially available, and the end walls 6 and 7 are plates recessed in and readily removable from the ends of this section of tubing. The box is fixedly mounted as indicated schematically at 8.

A web W moving continuously as shown by arrow 9 lies in a plane P underneath the box 1 and passes first over an upstream roller 10 fixed on the lower upstream corner of the box 1, then over an adjustment roller 18 fixed on the upper upstream corner of the box 1, then over a further adjustment roller 19 on the downstream upper corner of the box 1, and finally over a downstream roller 18 fixed on the lower downstream corner of this box 1. The two rollers 18 and 19 are carried on a tilt frame 12 formed by a pair of longitudinal members 13 and 14 extending parallel to the axes A of the rollers 18 and 19 and a pair of transverse members 15 and 16 bridging these longitudinal members 13 and 14. Pivot lugs 17 on the frame 12 support the ends of the rollers 18 for free rotation about their axes A.

At the upstream longitudinal beam 13 the frame 12 is mounted for pivoting about a vertical pivot axis 20 perpendicular to the plane P and to a plane define by the axes A. To this end the frame 12 has a downwardly extending pivot pin 21 received in a journal or bearing 22 mounted in the upper wall 3 of the box 1. The downstream longitudinal beam 14 carries at each end a downwardly projecting tab 23 carrying a pair of rollers 24 rotatable about vertically offset axes and flanking respective rails 25 permanently fixed to the respective corner of the upper wall 3.

Along the path followed by the web W between the rollers 19 and 11 there is provided a pair of edge sensors 26 and 27 of conventional design, which maybe of the microswitch or photoelectric-cell type.

Figure 2:
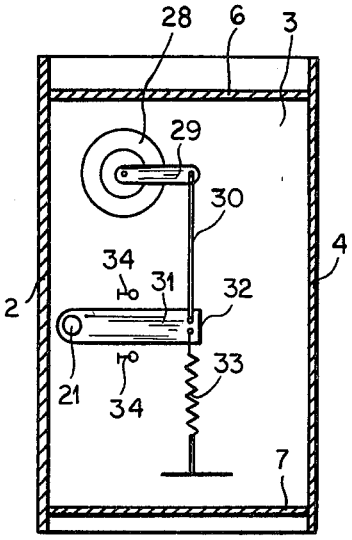
FIG. 2 is a bottom view of a detail of FIG. 1.

Fixedly mounted inside the box 1 is an electric motor 28 which may be of the stepping type and which has an output shaft carrying a crank arm 29 best seen in FIG. 2. This arm 29 extends radially of the motor output shaft and is connected at its free end via a link 30 to the free end 32 of an arm 31 carried on the lower end of the pivot pin 21 that carries the frame 12. Thus the motor 28 can pivot the arm 29 and, with it, the arm 31 so as to adjust the position of the frame 12 about the axis 20.

A tension spring 33 has one end hooked into the free end 32 of the arm 31 and another end hooked into a tab on the underside of the upper wall 3 of the box 1. This tension spring 33 therefore eliminates play from the linkage between the motor 28 and the frame 12. End abutments 34 are constituted as switches and are connected to a controller 35 which stops the motor 28 and sounds an alarm if the arm 31 is pivoted so far as to actuate either of these switches 34. Such a laterally offset position could damage the web W, and normally indicates serious problems.

A control line 37 connects the sensors 26 and 27 to the controller 35 and another line 36 connects the controller 35 to the motor 28. In addition various controls and gauges shown at 38 in FIG. 1 are mounted on the one recessed end wall 6 and are connected to the controller 35. Thus these gauges and controls are recessed out of harm's way while still being readily accessible to a person operating the machine, even while the web W is passing over the apparatus according to this invention at very high speed.

In the system according to the instant invention, therefore, when one of the sensors 26 or 27 detects that the edge of the web W is moved too far onto the side, it generates an error signal which is processed by the controller 35 to operate the motor 28. The system can be extremely simple, with each of the sensors 26 and 27 simply being a switch that can operate the motor 28 in one direction, so that only when the web W is perfectly centered between the two sensors 26 and 27 will the motor 28 be still. Other more complex system, such as for example using photocell sensors, analog-digital converters, and comparators can be provided if desired.

Figure 3:
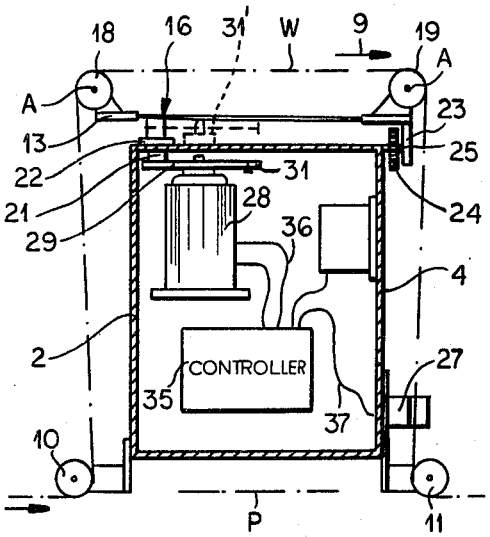
FIG. 3 is a cross section through the apparatus of FIG. 1.

It is also possible as shown at 31' in FIG. 3 to extend the motor shaft through the upper wall 3 of the box 1 and to mount the two arms 29 and 31 along with the spring 33 and link 30 between the frame 12 and the upper wall 3.

With the system according to the instant invention all of the critical mechanism and wiring for the apparatus will be safely sealed up in the completely closed box 1. It is possible for the motor 28 to be provided with some sort of cooling blower, for this purpose, however, a filter which should be provided at the intake for the blower in order to prevent drawing lint in the like into the apparatus. Under any circumstance an operator or user of the apparatus according to this invention will be protected from contact with the wiring or active mechanism.

I claim:

1. A guide apparatus for a continuously moving web, said apparatus comprising:

an upstream fixed roller and a downstream fixed roller substantially parallel thereto and defining a plane therewith:

a fixed and substantially closed box between said upstream and downstream rollers;

a frame offset from said plane and pivotal on said box about a frame axis substantially perpendicular to said plane;

a pair of adjustment rollers rotatably pivoted on said frame about parallel adjustment-roller axes fixed relative to each other and to said frame and offset from said plane, whereby a continuously moving web can pass along a path over said upstream roller, over one of said adjustment rollers, over the other adjustment roller, and over said downstream roller;

a sensor mounted along said web downstream of said other adjustment roller;

a motor inside said box connected to said frame and energizable to pivot said frame on said box about said frame axis; and control means in said box connected between said sensor and motor for pivoting said frame on said box when the web position detected by said sensor deviates for a predetermined desired position.

2. The apparatus defined in claim 1 wherein said sensor is mounted fixedly on said box between said other adjustment roller and said downstream rollers.

3. The apparatus defined in claim 1 wherein said box is provided at said frame axis with a bearing for said frame.

4. The apparatus defined in claim 3 wherein said frame is provided with a pivot pin extending along said frame axis through said bearing into said box, said apparatus comprising link means for interconnecting said pin and said motor.

5. The apparatus defined in claim 4 wherein said motor has a rotary output shaft, said link means including a motor arm mounted on said shaft, a pin arm mounted on said pin, and a link interconnecting said arms.

6. The apparatus defined in claim 5, further comprising a spring braced between said pin arm and said box and urging the free end of said pin arm away from said motor arm.

7. The apparatus defined in claim 5 wherein said arms lie between said frame and said box and said motor shaft extends through said box.

8. The apparatus defined in claim 1 wherein said frame has an upstream end provided with said one adjustment roller and located at said frame axis, a downstream end provided with said other adjustment roller, and means supporting said downstream end on said box for oscillatory motion about said frame axis.

9. The apparatus defined in claim 8 wherein said means supporting said downstream end includes at least one roller on said downstream end and a rail on said box on which said roller rides.

10. The apparatus defined in claim 1 wherein said box is formed of a substantially rectangular-section tube carrying said frame and a pair of end plates at least one of which is recessed in said tube.

11. The apparatus defined in claim 10 wherein said control means includes gauges and controls mounted on said one end wall, whereby said guages and controls are recessed out of harm's way.

12. The apparatus defined in claim 1 wherein said upstream and downstream rollers are carried on said box.

13. The apparatus defined in claim 12 wherein said adjustment rollers have axes lying in a plane substantially parallel to said plane of said upstream and downstream rollers.

14. The apparatus defined in claim 13 wherein said box is generally square in section and has four corners, each of said rollers being mounted adjacent a respective corner.

15. The apparatus defined in claim 1 wherein said apparatus has two such sensors spaced apart perpendicular to said web.

* * * * *